US007458103B2

(12) United States Patent
Citterio et al.

(10) Patent No.: US 7,458,103 B2
(45) Date of Patent: Dec. 2, 2008

(54) FLEXIBLE PENETRATION-RESISTANT PACKAGE AND USE THEREOF

(75) Inventors: Giorgio Citterio, Monza (IT); Christian Böttger, Remscheid (DE)

(73) Assignees: Teijin Aramid GmbH, Wuppertal (DE); F.LLI Citterio S.p.A., Monza (IT)

( * ) Notice: Subject to any disclaimer, the term of this patent is extended or adjusted under 35 U.S.C. 154(b) by 111 days.

(21) Appl. No.: 10/555,966

(22) PCT Filed: May 4, 2004

(86) PCT No.: PCT/EP2004/004720

§ 371 (c)(1),
(2), (4) Date: Jan. 13, 2006

(87) PCT Pub. No.: WO2004/099704

PCT Pub. Date: Nov. 18, 2004

(65) Prior Publication Data

US 2006/0223398 A1 Oct. 5, 2006

(30) Foreign Application Priority Data

May 8, 2003 (EP) ..... 03010327

(51) Int. Cl.
*F41H 1/02* (2006.01)

(52) U.S. Cl. ..... 2/2.5; 442/86; 442/134; 442/135; 442/324

(58) Field of Classification Search ..... 442/134, 442/135, 286, 324, 326, 86; 428/920, 921; 2/2.5

See application file for complete search history.

(56) References Cited

U.S. PATENT DOCUMENTS

| | | | | |
|---|---|---|---|---|
| 5,854,143 | A * | 12/1998 | Schuster et al. | 442/135 |
| 6,000,055 | A | 12/1999 | Citterio | |
| 6,022,601 | A | 2/2000 | Pfister et al. | |
| 6,138,275 | A | 10/2000 | Sacks | |
| 6,610,618 | B1 | 8/2003 | Bottger et al. | |
| 6,890,871 | B2 | 5/2005 | Bottger et al. | |
| 2004/0045428 | A1 | 3/2004 | Citterio | |
| 2004/0082242 | A1 | 4/2004 | Bottger et al. | |

FOREIGN PATENT DOCUMENTS

| | | | |
|---|---|---|---|
| EP | 0 805 332 | | 11/1997 |
| EP | 0 862 722 | | 9/1998 |
| GB | 1 556 245 | | 11/1979 |
| GB | 2 258 389 | A | 2/1993 |
| GB | 2349798 | * | 11/2000 |
| WO | WO 91/12136 | * | 8/1991 |
| WO | WO 97/21334 | | 6/1997 |
| WO | WO 00/42246 | | 7/2000 |
| WO | WO 01/78975 | | 10/2001 |
| WO | WO 02/075238 | A1 | 9/2002 |
| WO | WO 2004/074761 | A1 | 9/2004 |

* cited by examiner

*Primary Examiner*—Arti Singh
(74) *Attorney, Agent, or Firm*—Oliff & Berridge, PLC

(57) ABSTRACT

A flexible penetration-resistant package is described, comprising a) at least one laminate consisting of at least one layer of yarns comprising fibers with a strength of at least 900 MPa as per ASTM D-885, wherein the layer of yarns is bound to at least one polymer continuum having a modulus of elasticity in extension of 5 to 1000 MPa as per ASTM D-882 and wherein the package has an outer surface facing the side under attack and an inner surface facing away from the side under attack, and b) a layer of compressible material, the layer arranged either on the inner surface of the package or at such a position in the package between the laminates that from this position the number of laminates toward the outer surface of the package is at least twice the number of laminates toward the inner surface.

The package is used to produce protective clothing, in particular protective vests, suits, and mats.

25 Claims, No Drawings

FLEXIBLE PENETRATION-RESISTANT PACKAGE AND USE THEREOF

This application claims benefit of PCT/EP2004/004720 filed May 4, 2004, which claims the benefit of European Patent Application No. 03010327.9, filed May 8, 2003. The disclosures of the aforementioned applications are herein incorporated by reference in their entireties.

BACKGROUND

The present application relates to a flexible penetration-resistant package.

Materials of this type are described in EP 0 862 722 B1, for example. This specification discloses a penetration-proof composition having at least one layer having yarns made from fibers with a strength of at least 900 MPa as per ASTM D-885, wherein the layer is bound to a polymer continuum. The penetration-proof composition is used to manufacture protective clothing.

SUMMARY

Protective clothing must ensure the desired protection from projectiles, for example. The requirements placed on the ballistic protective action are constantly increasing. The present invention therefore addresses the object of providing a material with a higher degree of ballistic protection.

This object is achieved by a flexible penetration-resistant package comprising a) at least one laminate consisting of at least one layer of yarns comprising fibers with a strength of at least 900 MPa as per ASTM D-885, wherein the layer of yarns is bound to at least one polymer continuum having a modulus of elasticity in extension of 5 to 1000 MPa as per ASTM D-882 and wherein the package has an outer surface facing the side under attack and an inner surface facing away from the side under attack, and b) a layer of compressible material, the layer arranged either on the inner surface of the package or at such a position in the package between the laminates that from this position the number of laminates toward the outer surface of the package is at least twice the number of laminates toward the inner surface.

DETAILED DESCRIPTION

Since a compressible material offers no appreciable ballistic protective action as such, it must be regarded as surprising that the package according to the invention exhibits a higher ballistic protective action, expressed by the $v_{50}$ value, than a package without the compressible material. This is all the more true because the package according to the invention exhibits an increased $v_{50}$ value for a compressible material with a thickness of just a few, for example, 2 mm.

The package according to the invention comprises a polymer continuum that preferably has a modulus of elasticity in extension of 15 to 1000 MPa, for example, preferably 42 to 1000 MPa, and especially preferably 200 to 700 MPa, each as per ASTM D-882.

The number of laminates in the package according to the invention depends on the desired protective action, where a package comprising 5 to 100, especially preferably 15 to 70, laminates ensures the desired protective action for a large number of ballistic specifications.

The yarns of the package according to the invention can take a wide variety of forms. In a preferred embodiment of the package according to the invention, the yarns constitute a unidirectional structure, i.e., one in which all yarns lie in the same direction.

In another preferred embodiment of the package according to the invention, the yarns have a multidirectional structure, i.e., one in which the yarns of one layer are arranged at an angle other than 0°, preferably 20 to 90°, and especially preferably 90°, with respect to the yarns of the adjacent layer. For example, the yarn arrangements described in EP-A-0 805 332 and WO 01/78975 are also suitable for the present invention.

In another preferred embodiment of the package according to the invention, the yarns are woven fabrics, which preferably have a plain weave. However, other weaves such as twill, atlas, or hopsack are also suitable.

The woven fabrics of the package according to the invention have a thread count preferably in the range from 2 to 50 per cm and consist of yarns preferably having a titer from 50 to 3360 dtex.

The yarns of the package according to the invention can preferably comprise fibers selected from one or more groups consisting of the following fibers, provided that the fibers have a strength of at least 900 MPa as per ASTM D-885:

- polybenzoxazole fibers, in particular ZYLON® fibers,
- polybenzimidazole fibers, in particular M5 fibers,
- polyethylene fibers, in particular those made from ultra-high-molecular polyethylene (ECPE, extended chain polyethylene) such as SPECTRA®,
- polyimide fibers,
- polyester fibers, in particular those made from liquid-crystalline polyester such as VECTRAN®,
- polyaramide fibers, i.e., fibers in whose polymer at least 85% of the amide (CO—NH—) groups are directly bound to two aromatic rings, where para-aramide fibers (poly(p-phenylene terephthalamide) fibers) such as TWARON®, KEVLAR®, TECHNORA®, ARMOS®, TERLON®, or RUSAR® are especially preferred,
- aliphatic or cycloaliphatic polyamide fibers such as
  - copolyamides made of 30% hexamethylenediammonium isophthalate and 70% hexamethylenediammonium adipate,
  - copolyamides made of up to 30% bis-(amidocyclohexyl)-methylene, terephthalic acid, and caprolactam,
  - polyhexamethylene adipamide,
- polyvinyl alcohol fibers, such as KURALON®, made by Kuraray, and
- protein-based fibers such as BIOSTEEL®, made by Nexa.

In a preferred embodiment, the package according to the invention contains yarns made from fibers of only one of the cited fiber types, for example only polyaramide fibers, in particular poly(p-phenylene terephthalamide) fibers. Such fibers are available from Teijin Twaron under the designation TWARON®, for example.

In another preferred embodiment, the package according to the invention contains a woven fabric F in which the warp threads are yarns of polyaramide fibers and the weft threads are yarns of polyester fibers, where the woven fabric F is joined via the polymer continuum, hereafter called PC, to a woven fabric F' in which the warp threads are yarns of polyester fibers and the weft threads are yarns of polyaramide fibers, and the warp threads of F run parallel to the warp threads of F' and the weft threads of F run parallel to the weft threads of F'. The resulting layer comprises yarns in the order F/PC/F'.

In another, especially preferred embodiment, the package according to the invention has a layer of yarns that differs from the layer with yarns in the order F/PC/F' in that, in addition, both the fabrics F and F' are joined to a polymer continuum such that a layer of yarns in the order PC/F/PC/F'/PC is formed. Such sequences are described in WO 02/075238.

Furthermore, laminates such as those described in WO 00/42246 can be used in the package according to the invention.

The polymer continuum of the package according to the invention can be selected from a wide variety of polymers, provided it has a modulus of elasticity in extension of 5 to 1000 MPa as per ASTM D-882. Preferably, the polymer continuum is selected from the group of thermoplastic, elastomeric, or duromeric polymers, or from blends of these polymers, for example the group of polyimides, polyetheretherketones, ionomeric resins, phenolically modified resins, polyesters, and in particular polyethylenes. Especially preferred from the group of thermoplastic polymers is an LDPE film, from the group of elastomeric polymers with thermoplastic properties a polyurethane film.

Preferably, the layer of compressible material in the package according to the invention is laid on the inner surface of the package or between the laminates. However, the layer of compressible material can also be joined pointwise to at least one of the respective adjacent laminates, for example by quilting seams, pointwise application of adhesive, or spot welds.

Preferably, the package according to the invention contains a compressible material that is visibly compressible manually, thus compression by hand of the compressible material can be detected by eye.

In a preferred embodiment of the package according to the invention the compressible material exhibits a reduction in thickness in the range of 5 to 25% at a force of 100 N and of 10 to 46% at a force of 500 N, wherein in both cases said force acts perpendicular on the surface of the compressible material and the reduction in thickness is measured according to ASTM D 6478-00.

The compressible-material layer in the package according to the invention can be selected from a large number of compressible materials, where a compressible material is preferred that is selected from one of the groups consisting of foam plastics such as those made from polyethylene, felts such as those made from polyaramide, spacer fabrics or feathers such as down feathers, due to their low weight per unit volume. The weights per unit volume are preferably from 10 to 1000 kg/m$^3$ and especially preferably from 10 to 400 kg/m$^3$ and most preferable from 10 to 200 kg/m$^3$.

The action of the layer of compressible material in increasing the $v_{50}$ value is so pronounced that in the package according to the invention even a layer of compressible material in the range of 2 to 10 mm leads in many cases to an increase in the ballistic retention capacity, which is why this range is preferred.

In a further preferred embodiment of the invention at least a portion of the fibers is in contact with a polymer in the form of a viscous or visco-elastic liquid which maintains its fluid characteristics. Thus, besides the polymer continuum to which the layer of yarns is bound, the fibers can be in contact with a further polymer. For example, the fibers can be impregnated with a polymer in the form of a viscous or visco-elastic liquid.

The term visco-elastic liquid refers to a liquid, which has both an elastic and viscous behavior. Viscous behavior means that the liquid medium undergoes continues deformation when subjected to shear stress and remains deformed even when the stress is no longer applied. Elastic behavior means that the liquid medium undergoes deformation when subjected to shear stress and then returns to the original form when the stress is no longer applied.

The parameters used to describe a viscous or visco-elastic liquid are viscosity (with respect to the viscous behavior) and elastic modulus (G', also called elastic component) and the loss of elastic modulus (G", also called dissipative component) to describe the visco-elastic behavior. The viscosity and modulus in a polymer are generally correlated to the shear rate, molecular weight, temperature, pressure, crystallinity, concentration and composition.

The dynamic viscosity of the polymer ranges advantageously from 250 to 25,000,000 MPa·s at 25° C., preferably from 5,000 to 500,000 MPa·s, and more preferable from 50,000 to 25,000,000 MPa·s. The polymer has preferably a kinematic viscosity higher than 250 MPa·a at 25° C.

Another characterization of a viscous or visco-elastic liquid is its glass transition temperature $T_g$. The liquid polymer should have a $T_g$ lower than 0° C., and preferably from −40° C. to −128° C.

The molecular weight of the polymer should range from 250 to 50,000.

According to a preferred embodiment the liquid polymer shows a liquid behavior also at temperatures lower −40° C. and preferably up to −128° C. and has G">G'.

The viscous or visco-elastic liquid can be dissolved in a suitable dissolving medium in order to control its viscosity before being applied to the fibers. If the liquid has been previously diluted with a solvent, then the solvent is conveniently evaporated before subjecting the fibers to additional process.

Besides fillers like metallic powders, mineral-based powders, micro-balloons, wiskers or similar, one or more thickening agents can also be added to the viscous liquid polymer in order to modify the viscosity profile or provide thixotropy. To modify the viscosity for example block polymers, paraffinic oils, waxes of their mixtures are suitable. It is also possible to add to the liquid polymer other substances suitable for providing specific characteristics to the fibers such as hydro-oil repellency, such as silicones, fluorocarbons and oils. The additional fillers and/or polymers must not however vary the physical liquid state of the polymer.

The polymer in the form of a viscous or visco-elastic liquid is preferably selected from the group comprising polyolefins, polyvinyl alcohol, polyisoprenes, polybutadienes, polybutenes, polyisobutylenes, polyesters, polyacrylates, polyamides, polysulfones, polysulfides, polyurethanes, polycarbonates, fluorocarbons, silicones, glycols, liquid block copolymers, polyacrylic, epoxy, phenolic, liquid rubbers and their mixtures. Especially preferred is a polybutene based polymer.

Particular suitable are non-Newtonian liquid fluids, also thixotropic and preferably visco-elastic liquid fluids.

Further details regarding the measurement of the characteristics of the preferred polybutene based fluid polymer are disclosed in Italian patent application No. MI2003A000295 hereby incorporated by reference.

The partial or total application or impregnation of a fiber with a polymer in the form of a viscous or visco-elastic liquid allows each filament of the fibers to slip on the adjacent filaments. This improves the flexibility and ballistic properties.

Preferably the package according to the invention is placed in a cover which for example is one made from textile material.

The manufacture of the package according to the invention can be carried out, for example, as follows:

a) The woven fabric and polymeric continua, the latter in the form of a film, for example, are superimposed to form a preliminary laminate, b) A number of preliminary laminates required for a certain ballistic protective action are produced in the manner stated in a), c) The number of preliminary laminates produced in b) are superimposed, separated in each case by separating paper, d) The resulting stack is pressed together in a static press at a temperature preferably from 80 to 220° C., a pressure preferably from 5 to 100 bar, and for a period preferably from 15 seconds to 25 minutes, after which the heating of the press is turned off, e) The laminates are unstacked to remove the separating paper, f) The laminates are stacked again without the separating paper, and g) A layer of compressible material is laid onto the stack, i.e., on what will later be the inner surface of the package.

As a result of its increased ballistic protective action, the package according to the invention can advantageously be used in making protective clothing such as protective vests, in particular bulletproof vests, or protective suits or mats.

The invention will be explained in more detail in the following examples.

EXAMPLES

Example 1

$v_{50}$ as a Function of the Foam Thickness

A package according to the invention, in which the yarns are in the form of a woven fabric, is produced as described in the following:

The woven fabric F employed is one made from polyparaphenylene terephthalamide warp threads (TWARON®, made by Teijin Twaron), with a titer of 930 dtex, a thread count of 9.5 per cm, and a filament diameter of 0.0092 mm, and from polyester weft threads (TREVIRA®, made by Kosa), with a titer of 140 dtex and a thread count of 2 per cm.

The polymeric continuum PC is an LDPE film available from EKB Kunststoffe under the designation "LDPE-Flachfolie, transparent, 11 μm", with a modulus of elasticity in extension of 300 MPa as per ASTM D-882, a tensile strength of 26 MPa as per ASTM D-638, and an elongation at rupture of 98±12% as per ASTM D-638.

The woven fabric F' employed is one made from polyparaphenylene terephthalamide weft threads (TWARON®, made by Teijin Twaron), with a titer of 930 dtex, a thread count of 9.5 per cm, and a filament diameter of 0.0092 mm, and from polyester warp threads (TREVIRA®, made by Kosa) with a titer of 140 dtex and a thread count of 2 per cm.

F, PC, and F' are used to make 23 preliminary laminates, where the order of each such laminate is PC/F/PC/F'/PC, the warp threads of F run parallel to the warp threads of F', and the weft threads of F run parallel to the weft threads of F'.

The 23 preliminary laminates are superimposed, with separating paper in each case, and pressed in a static press at a temperature of 120° C. and a pressure of 25 bar for 25 minutes.

Subsequently, the 23 laminates are unstacked and the separating paper removed, and the 23 laminates again superimposed. In this manner, two comparison packages are produced (see Ca and Cb in Table 1).

Furthermore, two packages according to the invention are produced, which are constructed like Ca and Cb and each of which additionally has a 3 mm thick layer of polyethylene foam (see P1a and P1b in Table 1).

Then, two packages according to the invention are produced, which are constructed like Ca and Cb and each of which additionally has a 5 mm thick layer of polyethylene foam (see P2a and P2b in Table 1).

Finally, two packages according to the invention are produced, which are constructed like Ca and Cb and each of which additionally has an 8 mm thick layer of polyethylene foam (see P3a and P3b in Table 1).

The polyethylene foam used in each case is one designated as type AT and available from Iso Chemie, with a weight per unit volume of 33 kg/m$^3$.

The ballistic protective action of the comparison packages C, and of the packages P1-P3 according to the invention, is determined by obtaining the $v_{50}$ value, i.e., the velocity at which half of the projectiles penetrate and half lodge in the target, in accordance with the technical guidelines "Schutzwesten der deutschen Polizei" ("Protective vests for the German Police"), with 9×19 caliber type DM41 ammunition (available from DAG). In each of the packages P1-P3 according to the invention, the side having the polyethylene foam is the inner surface facing away from the side under attack.

Table 1 contains the individual $v_{50}$ values for the (comparison) packages and their arithmetic means.

TABLE 1

$v_{50}$ values as a function of the foam thickness

| | Foam thickness [mm] | $v_{50}$ [m/s] | $v_{50}$ mean [m/s] |
|---|---|---|---|
| Ca | — | 483 | 485 |
| Cb | — | 487 | |
| P1a | 3 | 515 | 513 |
| P1b | 3 | 511 | |
| P2a | 5 | 537 | 540 |
| P2b | 5 | 543 | |
| P3a | 8 | 541 | 541 |
| P3b | 8 | 540 | |

Table 1 shows that the $v_{50}$ mean increases by 28 m/s for a foam thickness of just 3 mm. For a thickness of 8 mm, the $v_{50}$ mean increases by 56 m/s, i.e., by 11.6%. Expressed as kinetic energy, this means an increase in the ballistic protective action of 24.4%.

Example 2

Trauma as a Function of the Thickness of the Polyethylene Foam

In each case, a total of 23 laminates as in example 1 were subjected to fire under the conditions of example 1 but with a constant projectile velocity, which was selected such that the projectiles lodged in the target in each case. In this manner, a package not according to the invention, comprising 23 laminates without polyethylene foam, and three packages according to the invention, comprising 23 laminates with 3, 5, and 8 mm polyethylene foam, respectively, were subjected to fire 5 times. The trauma was determined as the penetration depth of the projectile in plastiline, available from Weible. Table 2 contains the arithmetic means of the projectile velocity v and the trauma. ±d designates the maximum deviation of the projectile velocity or trauma, respectively.

TABLE 2

Trauma as a function of the foam thickness

| Foam thickness [mm] | v ± d [m/s] | Trauma ± d [mm] |
|---|---|---|
| No foam | 410 ± 5 | 31 ± 3 |
| 3 | 409 ± 2 | 32 ± 2 |
| 5 | 414 ± 8 | 35 ± 7 |
| 8 | 412 ± 7 | 33 ± 5 |

While the data in Table 1 shows that the ballistic protective action is significantly increased by the foam according to the invention, Table 2 shows that, within the maximum derivation, the trauma remains unchanged by the foam.

The invention claimed is:

1. Flexible penetration-resistant package, comprising a) at least one laminate consisting of at least one layer of yarns comprising fibers with a strength of at least 900 MPa as per ASTM D-885, wherein the layer of yarns is bound to at least one polymer continuum having a modulus of elasticity in extension of 5 to 1000 MPa as per ASTM D-882, and wherein the package has an outer surface facing the side under attack and an inner surface facing away from the side under attack, and b) a layer of compressible material, the layer arranged either on the inner surface of the package or at such a position in the package between the laminates that from this position the number of laminates toward the outer surface of the package is at least twice the number of laminates toward the inner surface, wherein the polymer continuum comprises a thermoplastic polymer, an elastomeric polymer, a duromeric polymer, polyamides, polyetherketones, ionomeric resins, phenolically modified resins, polyesters, polyethylenes, or mixtures thereof, and wherein the compressible material is selected from the groups consisting of foam plastics, feathers and spacer fabrics.

2. Package according to claim 1, wherein the polymer continuum has a modulus of elasticity in extension of 15 to 1000 MPa according to ASTM D-882.

3. Package according to claim 1, wherein the polymer continuum has a modulus of elasticity in extension of 42 to 1000 MPa according to ASTM D-882.

4. Package according to claim 1, wherein the package comprises 5 to 100 laminates.

5. Package according to claim 1, wherein the yarns constitute a unidirectional structure.

6. Package according to claim 1, wherein the yarns constitute a multidirectional structure.

7. Package according to claim 1, wherein the yarns are in the form of a woven fabric.

8. Package according to claim 1, wherein the yarns comprise fibers that are selected from one or more of the groups consisting of polybenzoxazole, polybenzimidazole, polyethylene, polyimide, polyester, polyaramide, and aliphatic or cycloaliphatic polyamide fibers.

9. Package according to claim 1, wherein the compressible material is visibly compressible manually.

10. Package according to claim 1, wherein the compressible material exhibits a reduction in thickness in the range of 5 to 25% at a force of 100 N and of 10 to 46% at a force of 500 N, wherein in both cases said force acts perpendicular on the surface of the compressible material and the reduction in thickness is measured according to ASTM D 6478-00.

11. Package according to claim 1, wherein the compressible material has a weight per unit volume of 10 to 1000 $kg/m^3$.

12. Package according to claim 1, wherein the compressible material has a weight per unit volume of 10 to 200 $kg/m^3$.

13. Package according to claim 1, wherein the layer of compressible material has a thickness of 2 to 10 mm.

14. Package according to claim 1, wherein at least a portion of the fibers is in contact with a polymer in the form of a viscous or visco-elastic liquid.

15. Package according to claim 14, wherein the polymer is a non-Newtonian visco-elastic liquid.

16. Package according to claim 14, wherein the polymer is in the form of a visco-elastic liquid, and wherein the dissipative component G" is greater with respect to the elastic component G'.

17. Package according to claim 14, wherein the polymer has a dynamic viscosity ranging from 250 to 25,000,000 MPa ·s at 25° C.

18. Package according to claim 14, wherein the polymer has a molecular weight ranging from 250 to 50,000.

19. Package according to claim 14, wherein the polymer has a kinematic viscosity higher than 250 MPa ·s at 25° C.

20. Package according to claim 14, wherein the polymer is selected from the group consisting of polyolefins, polyvinyl alcohol, polyisoprenes, polybutadienes, polybutenes, polyisobutylenes, polyesters, polyacrylates, polyamides, polysulfones, polysulfides, polyurethanes, polycarbonates, fluorocarbons, silicones, glycols, liquid block copolymers, polyacrylic, epoxy, phenolic, liquid rubbers and their mixtures.

21. Package according to claim 14, wherein the polymer is in liquid form down to a temperature of −128° C.

22. Package according to claim 14, wherein the polymer is a liquid with a thixotropic behavior.

23. Package according to claim 1, wherein the package is placed in a cover.

24. Protective clothing, comprising the package according to claim 1.

25. Protective clothing according to claim 24, wherein the protective clothing is a protective vest, a protective suit or a protective hat.

* * * * *